US005265365A

United States Patent [19]

Finn

[11] Patent Number: 5,265,365

[45] Date of Patent: Nov. 30, 1993

[54] POUCH AND CHEEK PIECE FOR LONG GUNS

[76] Inventor: Charles A. Finn, 2955 Cottingham St., Oceanside, Calif. 92054

[21] Appl. No.: 818,297

[22] Filed: Jan. 9, 1992

[51] Int. Cl.[5] ..... F41C 23/00

[52] U.S. Cl. ..... 42/74; 42/90; 42/106; 224/239

[58] Field of Search ..... 42/74, 90, 106; 224/239

[56] References Cited

U.S. PATENT DOCUMENTS

| | | | |
|---|---|---|---|
| 2,193,310 | 3/1940 | Brant | 42/74 |
| 2,282,428 | 5/1942 | Rigandi | 42/74 |
| 2,605,033 | 7/1952 | Terry | 42/90 |
| 5,121,564 | 6/1992 | Story | 42/90 |

OTHER PUBLICATIONS

Bass Pro Shops, *Outdoor World Hunting Catalog*, Fall 1991.

*Primary Examiner*—J. Woodrow Eldred

*Attorney, Agent, or Firm*—Wagner & Middlebrook

[57] ABSTRACT

Disclosed is a combination flexible cheek piece, stock cover, ammunition holder and pouch for long guns such as rifles and shotguns. The combination is designed to be held about the stock of a long gun by adjustable straps which hold the device securely on the stock of the gun. One face presents a cheek piece for the shooter. The opposite face presents a series of cartridge loops as well as pouch for holding small items. In one embodiment, a second pouch is secured to the top of the device to elevate the cheek piece, particularly for use with rifles carrying a telescopic sight. Hook and pile type fasteners are used for effective adjustable fit.

7 Claims, 3 Drawing Sheets

FIG. 6
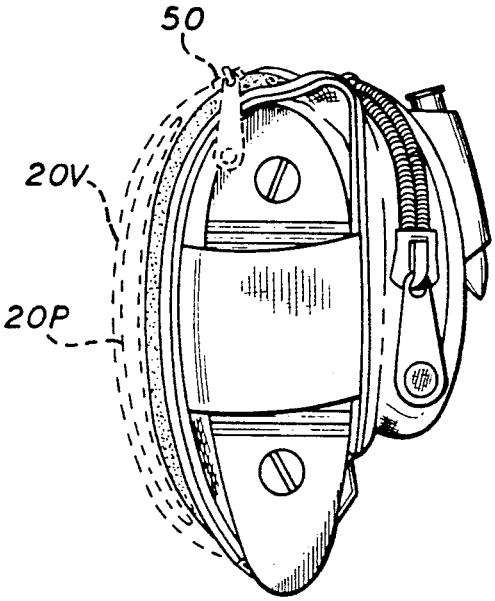
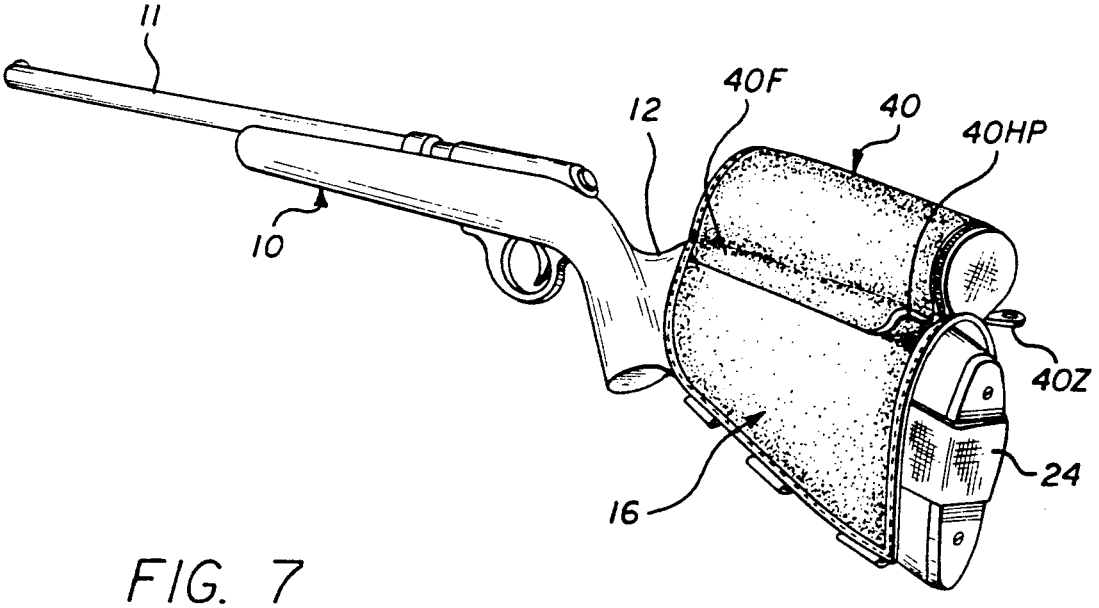
FIG. 7

POUCH AND CHEEK PIECE FOR LONG GUNS

BACKGROUND OF THE INVENTION

Through the years, many attachments and accessories have been developed for firearms including long guns such as rifles and shotguns. These include a myriad of forms of stocks and butt pads, telescopic and other improved sights as well as stocks with adjustable cheek pieces. Many of these, to an extent, improve the operation of the long gun. Additionally, many types of gun cases and covers have been developed from the hard sided fitted case to the flexible lined case to simple stock covers. The purpose of these covers is, of course, to protect the long gun from damage in storage or transit.

Often the stock is produced from expensive beautiful wood and finished with engraving, insets and attractive finish. Damage to such stocks cannot be allowed. Unfortunately, nearly all such cases and covers are necessarily removed in the field leaving the stock subject to damage from brush and terrain while hunting or other causes while on a skeet or trap range.

Apart from the need for protection for the stock of a long gun, there also exists, in many cases, a need for adjusting the cheek piece or rest to fit a particular shooter. Most long guns have symmetrical stock sides for use by either left or right handed shooters. Some long guns have built up cheek pieces, particularly for right handed shooters. The built up portions are outward extending oval integral portions of the stock. They are either custom carved or designed to fit an average shooter. These integral cheek pieces, when they fit the shooter, do provide a better feel and, we hope, better accuracy and comfort for the shooter.

As a further refinement, but usually detracting from the appearance of the stock are adjustable cheek pieces built in to the stock.

Even with adjustable cheek pieces, most are adjustable to fit different shooters using the stock long gun with its normal or iron sights. When a telescopic sight is added, the shooter's cheek should rest well above the normal cheek piece location and the stock is more likely to rest against the shooter's chin than cheek, an unsatisfactory arrangement.

One further accessory which has some utility for the shooter is an ammunition carrier which is at hand whether by attachment to or building into the stock. Having a few rounds readily available without leaving the firing position is favored by some shooters and thus, some ammunition cases associated with the stock have been developed including small strap on cases.

Examples of the foregoing are the following U.S. patents which represent the state of the art are:

| | | |
|---|---|---|
| 3665,990 | GUN STOCK COVER | May 30, 1972 |
| D309,002 | COMBINED GUN STOCK AND BUTT COVER | July 3, 1990 |
| D300,343 | REMOVABLE CHEEK REST FOR A RIFLE STOCK | Mar. 21, 1989 |
| 5,031,348 | GUN STOCK ASSEMBLY WITH COORDINATED COMB AND RECOIL | July 16, 1991 |

BRIEF DESCRIPTION OF THE INVENTION

I have been a shooter and designer of firearms and accessories for many years and, as others, through the years have accepted the limitations of long guns and their accessories.

Recently, I took a long hard look at these problems and concluded that there was no reason for the shooter to have to live with them. I came to the conclusion that it would be possible to produce a flexible fabric like cover for the stock of a long gun which protects the stock, provides a proper cheek piece for the shooter, whether left or right handed, also accommodates for the change of position of the cheek when using a telescopic sight and to provide for ammunition and small article storage on the stock. These are all provided without modification of the long gun nor degradation of its appearance or performance.

I have accomplished the foregoing in a stock cover of fabric having a generally trapezoidal shape when open with two longer angled sides which form the left and right faces of the cover when folded both the stock of a long gun such as a rifle or shotgun. Straps are secured to one long side and pass through D rings in the opposite edge and are foldable for securement by hook and pile fasteners to hold the cover on the stock. An end strap is likewise adjustable to position the cover as any selected position along the stock.

One outer face of the cover includes a cheek piece with a non slip surface such as suede or imitation suede material. The opposite face preferably includes a number of ammunition loops extending longitudinally along the stock cover. The loops are sized to receive the type of ammunition used in the long gun for which the cover is intended. Elastic loops may be used where it is desired to fit a number of different sizes of ammunition.

The cover also includes a longitudinally extending zipper which encloses a pocket or pouch for carrying small items of the type which are often needed but seldom within easy reach while shooting.

The cheek piece side of the cover may have a similar zipper to allow the interior to be stuffed with thickness adding material if the shooter wishes to expand the cheek piece. This can be done to allow the shooter to customize the cheek piece to his own preferences.

BRIEF DESCRIPTION OF THE DRAWING

This invention may be more clearly understood from the following detailed description and by reference to the drawing in which:

FIG. 6 is a butt end view of the rifle of FIGS. 1-5; and

FIG. 7 is a perspective view of an alternate embodiment of this invention with an additional pouch added to the top of the cheek piece and cover of FIGS. 1-6 to raise the height of the cheek piece particularly for use with a telescopic sight.

DETAILED DESCRIPTION OF THE INVENTION

Figure 1:
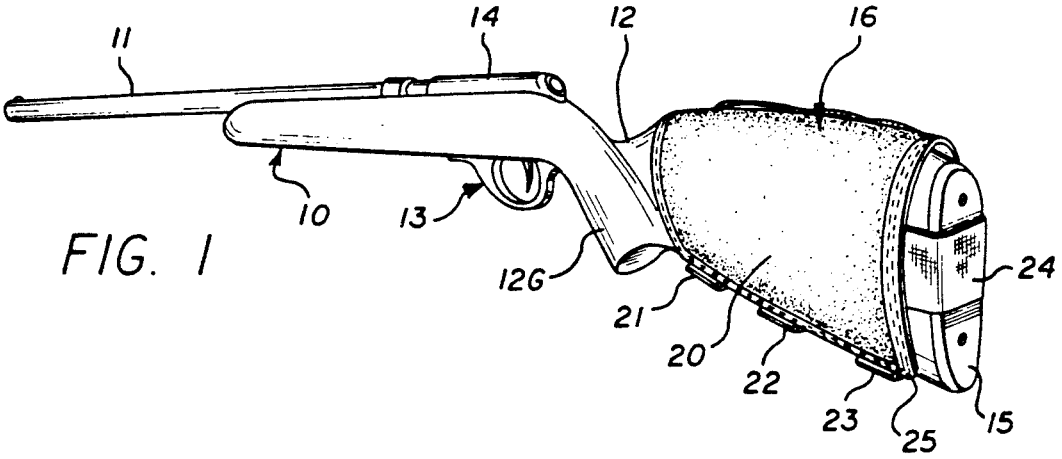
FIG. 1 is a perspective view of a rifle with a stock cover and cheek piece of this invention mounted on the stock of the rifle.
Figure 2:
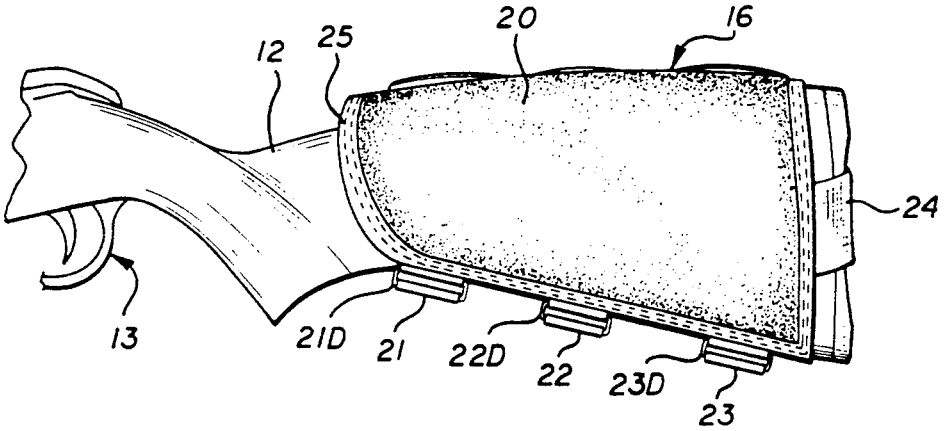
FIG. 2 is a fragmentary side elevational view of the rifle of FIG. 1 showing the cheek piece side of the cover of FIG. 1.

Now referring to FIGS. 1-5, a conventional bolt action rifle 10 may be seen with a barrel 11, a stock 12, trigger assembly 13 and a bolt action 14. The stock 12 includes a butt plate 15 which rests against the shooter's shoulder when in a firing position. Surrounding a major portion of the rear of the stock 12 is the cheek piece and cover 16 of this invention. It includes a cheek piece surface 20 which extends over one side of the stock 12 and has a non slip surface such as suede leather or imitation suede.

Figure 4:
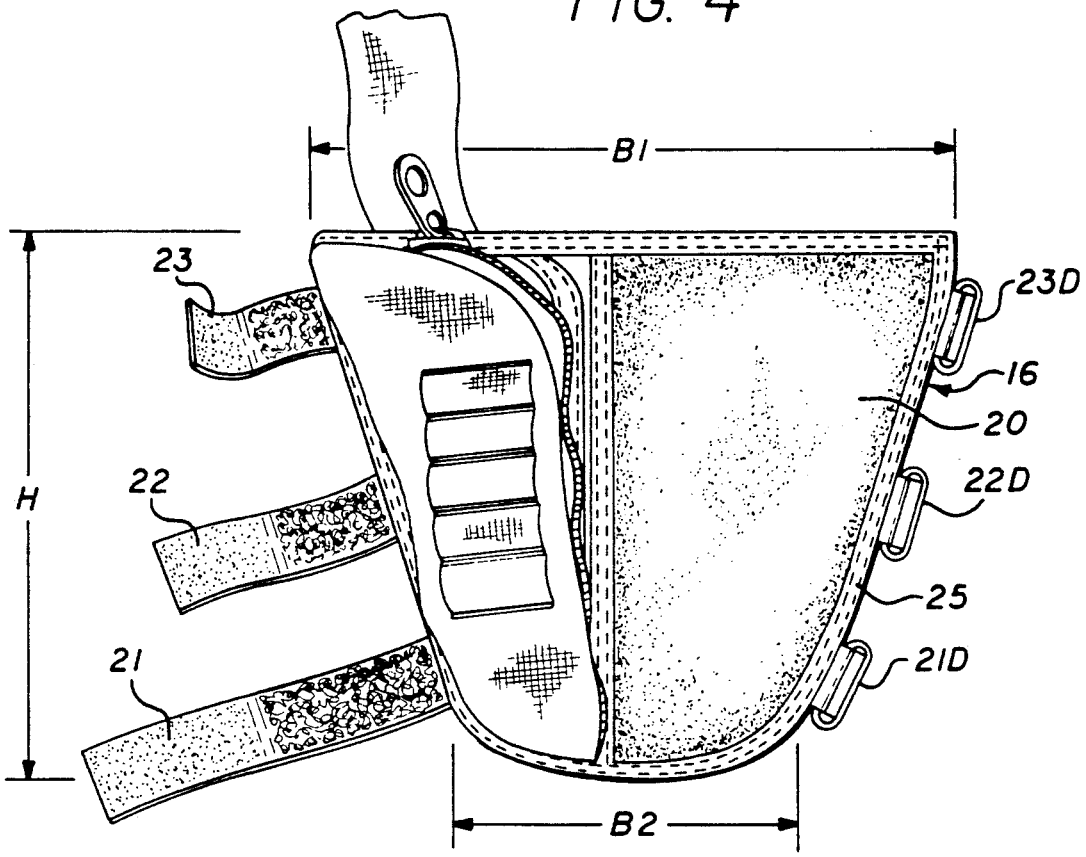
FIG. 4 is an outer side view of the cheek piece and cover of FIGS. 1-3.

The cheek piece and cover 16 is secured to the long gun 10 by means of a number of straps, 21-24. Straps 21-23 are preferably secured to the edge of the side opposite the cheek piece surface 20, as by sewing within an edge piping 25. The cheek piece side 20 of the cover 16 includes at its edge a plurality of D rings 21D-23D secured to the piping 25 as by sewing. The straps 21-23, preferably employ pile type fastener material 21P-23P on its outer surface for approximately one half of its length and hook type fastener material 21H-23H for the remaining half of its outer surface as best seen in FIG. 4. This allows the straps 21-23 to be passed through their respective D rings 21D-23D and returned to fasten the hook and pile surfaces together and secure the cheek piece and cover 16 about the stock 12.

Figure 5:
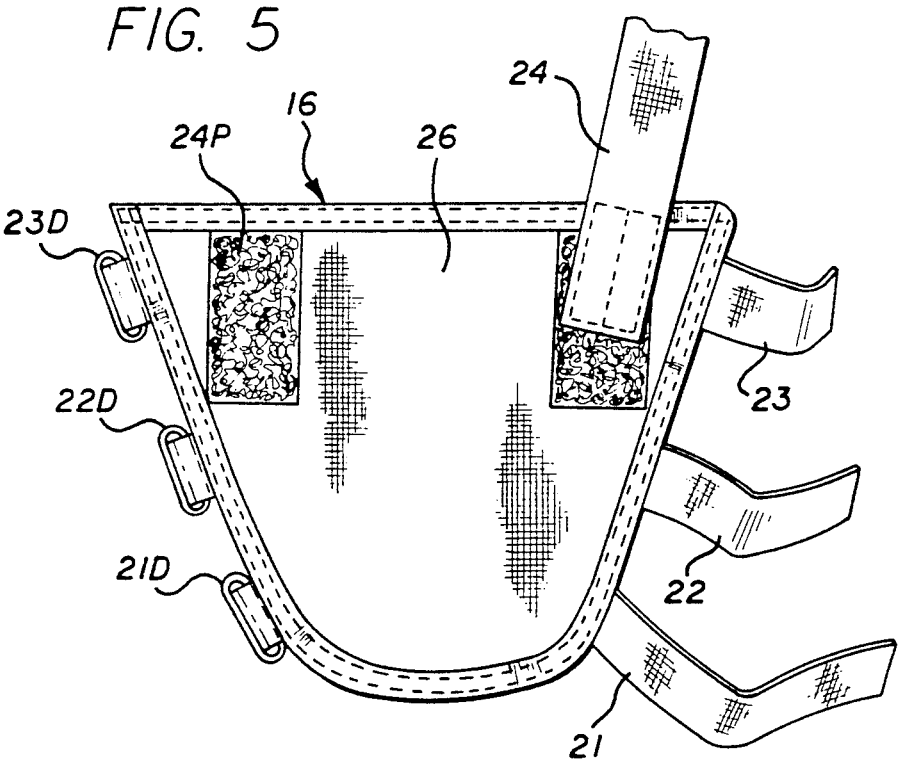
FIG. 5 is an inner side view of the cheek piece and cover of FIGS. 1-4.

The hook and pile fasteners 21P & H-23 P & H is particularly suitable for this use since it allows the cheek piece and cover 16 to accommodate to different size stocks and also to allow different longitudinal positioning of the cheek piece and cover 16 along the length of the stock 12. The longitudinal positioning is determined by the additional strap 24 which is secured as by sewing to the underside of the cover 16 at the larger end thereof. Strap 24 includes hook or pile fastener material on its outer surface toward the end which mates with a length of mating fastener material 24P which is affixed as by sewing to the inside of the cover 16 as best seen in FIG. 5. When the two sides of the cover 16 are folded about the stock 12 with the free end of the strap 24 engaging its mating fastener 24P, the cover 16 is secured on the stock 12 from any movement rotationally about the stock or longitudinally. The cheek piece 20 then is secured to the stock 12 and the shooter may fire with confidence and comfort.

Figure 3:
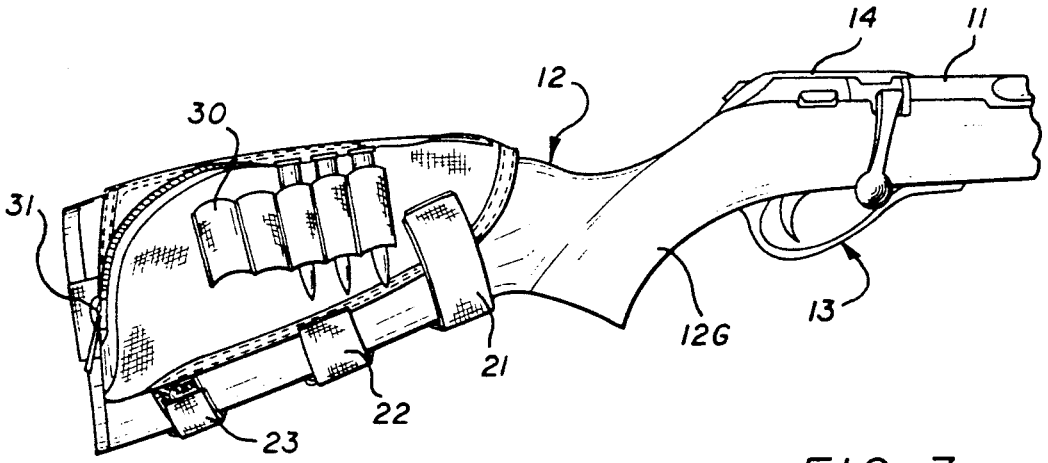
FIG. 3 is fragmentary side elevational view of the rifle of FIGS. 1 and 2 showing the pouch and ammunition carrying side of the cover of FIGS. 1 and 2.

FIG. 3 shows the surface opposite the cheek piece and the ammunition storage loops 30 as well as a zipper closure 31 which closes an internal pouch, best seen in FIG. 6.

FIGS. 4 and 5 illustrate that the preferred form for the cheek piece and cover 16 is preferably trapezoidal in shape although shown inverted in FIGS. 4 and 5 and with the minor base B2 actually somewhat rounded. The major base length B1 has a length which approximates the peripheral distance around the stock of its intended long gun at a point aft or rearward from the normal cheek position which is indicated in FIG. 1 by the letter C. The minor base B2 has a length which approximates the peripheral distance around the stock 12 at a position forward of the normal cheek position C. The height H of the trapezoidal shaped flexible body approximates or is shorter than the length of the stock behind the grip portion 12G to the butt. Owing to the adjustability of the straps the cheek piece and cover 16 of this invention may easily be adjusted to fit a variety of long guns.

The cheek piece 20 is of double thickness as illustrated in FIGS. 1-6 with it liner 26. However its is possible to provide a variable height cheek piece 20V as illustrated in FIG. 6 by the dashed lines denoting a second zipper closure 50 and additional removable internal padding 20P.

In the embodiment shown in the drawing, FIGS. 1-6, the following dimensions have been found to fit a broad range of long gun stocks:

| | | |
|---|---|---|
| Base B1 | | 9½ inches, 24 cm |
| Base B2 | | 4½ inches, 11 cm |
| Height H | | 7¾ inches, 19.5 cm |
| Strap 21 | L | 7 inches, 17 cm |
| Strap 22 | L | 4 inches, 10 cm |
| Strap 23 | L | 3 inches, 8 cm |
| Strap 24 | L | 10 inches, 25 cm |

The strap widths are all 1 inch, 2.5 cm.

The preferred materials are as follows:

| | |
|---|---|
| Cheek piece | synthetic suede |
| liner | nylon |
| pouch | cordera |
| fasteners | hook and pile (VELCRO type) |

Referring now to FIG. 7, an additional pouch 40 appears at the top of the cover 16. It is held in place either by a zipper connection or by hook and pile fastener 40HP as illustrated. Preferably the pile fastener is on the cheek 20 surface at the top of the stock and the hook fastener is on the underside of flap 40F of pouch 40. The pouch 40 adds additional height to the cover 16 and extends the cheek piece 20 higher to accommodate the higher positioning of the cheek when using a telescopic sight. It also affords additional storage space in its interior via zipper opening 40Z.

The foregoing describes the best mode known by this inventor in carrying out his invention and the embodiments shown are by way of illustration and not limitation. It is recognized that one skilled in the art might vary from the embodiments here illustrated without departing from the principle and concept of the invention.

The above described embodiments of the present invention are merely descriptive of its principles and are not to be considered limiting. The scope of the present invention instead shall be determined from the scope of the following claims including their equivalents.

What is claimed is:

1. A cheek piece addition for a long gun having a stock with a pair of side faces and a butt portion comprising:

a flexible body of material dimensioned to cover a substantial portion of said side faces of a long gun stock;

means securing the said flexible body of material to a long gun stock, said means comprising a plurality of straps, at least one of said straps securing said flexible body around the butt portion of the long gun on which it is installed;

said flexible body presenting a cheek piece having a smooth suede-like surface on one side face of a long gun stock upon which it is mounted, said flexible body further including a pouch therein located on the second of the pair of side faces of the stock of the long gun when positioned thereon, said flexible body including means for holding ammunition secured to said flexible body;

said means for holding ammunition located on the surface of the flexible body positioned on the second of the pair of side faces of the stock of the long gun.

2. A cheek piece addition in accordance with claim 1 wherein a second pouch is located on the same face of said flexible body as the cheek piece.

3. A cheek piece in accordance with claim 1 wherein said means for holding ammunition is secured to said pouch.

4. A cheek piece addition in accordance with claim 1 wherein said flexible body includes a first side carrying said cheek piece and a second side carrying said pouch and another of said plurality of straps engages said first and second sides to secure said flexible body laterally to the stock portion of said long gun.

5. A cheek piece addition in accordance with claim 1 wherein said flexible body is of generally trapezoidal shape with the trapezoidal height being less than the length of the stock of a long gun for which it is intended to be used; a minor base of length approximately the circumferential distance around the stock ahead of the cheek location when in a firing position and the major base of said trapezoidal shaped flexible body having length approximately the circumferential length of the stock behind the cheek location when in a firing position.

6. A cheek piece addition in accordance with claim 4 including a supplementary elongated fabric body and means for securing said supplementary elongated body to the outer face of said flexible body between said first and second sides to extend said cheek piece above the level of said stock.

7. A cheek piece addition in accordance with claim 6 wherein said supplementary elongated body is a pouch.

* * * * *